US007163046B2

(12) United States Patent
Tanaka et al.

(10) Patent No.: US 7,163,046 B2
(45) Date of Patent: Jan. 16, 2007

(54) METHOD AND APPARATUS FOR INJECTION MOLDING LIGHT METAL ALLOY

(75) Inventors: Tatsuya Tanaka, Takasago (JP); Munenori Soejima, Takasago (JP); Katsunori Takahashi, Takasago (JP); Takeshi Kanda, Takasago (JP); Kazuhisa Fujisawa, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 10/914,153

(22) Filed: Aug. 10, 2004

(65) Prior Publication Data

US 2005/0006046 A1 Jan. 13, 2005

Related U.S. Application Data

(63) Continuation of application No. 09/550,331, filed on Apr. 14, 2000, now Pat. No. 6,840,302.

(30) Foreign Application Priority Data

| | | |
|---|---|---|
| Apr. 21, 1999 | (JP) | 11-113724 |
| May 7, 1999 | (JP) | 11-127448 |
| May 21, 1999 | (JP) | 11-142072 |
| Mar. 8, 2000 | (JP) | 2000-063922 |

(51) Int. Cl.
*B22D 17/00* (2006.01)

(52) U.S. Cl. ..... 164/312; 164/113

(58) Field of Classification Search ..... 164/113, 164/900, 312
See application file for complete search history.

(56) References Cited

U.S. PATENT DOCUMENTS

| | | | |
|---|---|---|---|
| 2,753,605 | A | 7/1956 | Carleton, Jr. |
| 3,773,098 | A | 11/1973 | Rock |
| 4,174,965 | A | 11/1979 | Buxman |
| 4,203,580 | A | 5/1980 | Buxman |
| 5,040,589 | A | 8/1991 | Bradley et al. |
| 5,388,633 | A | 2/1995 | Mercer, II et al. |

(Continued)

FOREIGN PATENT DOCUMENTS

| | | |
|---|---|---|
| JP | 1-166874 | 6/1989 |

(Continued)

*Primary Examiner*—Len Tran
(74) *Attorney, Agent, or Firm*—Oblon, Spivak, McClelland, Maier & Neustadt, P.C.

(57) ABSTRACT

The apparatus of the invention is an injection molding apparatus of a type adapted to cool a molten metal under shearing by an extrusion screw in a substantially vertical chamber into a semi-solidified slurry and then inject the semi-solidified slurry discharged from a discharge port at the lower end of a channel into molding plates, in which a clamping device is adapted to open or close a movable plate relative to a stationary plate in the horizontal direction, and a connection member having, at the inside, a vertical first channel and a second channel extending in the horizontal direction from the lower end of the first channel and in communication with the stationary plate is connected to the discharge port at the lower end of the chamber. Since this can inject and mold light metal molding products of high quality with less pore or shrinkage without excessively enlarging the size for the height of the apparatus, casting products of high quality can be obtained at a reduced cost by injection molding.

7 Claims, 14 Drawing Sheets

U.S. PATENT DOCUMENTS

| | | | |
|---|---|---|---|
| 3,208,637 | A | 9/1995 | Heick |
| 5,501,266 | A | 3/1996 | Wang et al. |
| 5,657,815 | A | 8/1997 | Sugitani |
| 5,836,372 | A | 11/1998 | Kono |
| 6,135,196 | A | 10/2000 | Kono |

FOREIGN PATENT DOCUMENTS

| | | |
|---|---|---|
| JP | 01166874 | 6/1989 |
| JP | 07051827 | 2/1995 |
| JP | 9-103859 | 4/1997 |
| JP | 9-108805 | 4/1997 |
| JP | 9-155520 | 6/1997 |
| JP | 9-239512 | 9/1997 |
| JP | 9-508859 | 9/1997 |
| JP | 3-504830 | 10/1997 |
| JP | 2832625 | 10/1998 |
| JP | 11-033693 | 2/1999 |
| JP | 1-192447 | 8/1999 |

METHOD AND APPARATUS FOR INJECTION MOLDING LIGHT METAL ALLOY

The present application is a continuation of U.S. patent application Ser. No. 09/550,331, filed on Apr. 14, 2000, now U.S. Pat. No. 6,840,302 the entire contents of which are hereby incorporated by reference herein.

BACKGROUND OF THE INVENTION

1. Field of the Invention

The present invention concerns a method of and an apparatus for injection a molding light metal alloy such as of magnesium and aluminum.

2. Description of the Related Art

As a method of molding light metal alloy materials in a manner similar with injection molding of resins, there has been known a method of injecting a light metal alloy material in a semi-solidified slurry into a molding die. Generally, raw metal alloy materials are formed into a semi-solidified state by heating a raw material pellet in a screw extruder as disclosed in International Patent Publication Hei 3-504830 or by granulating raw ingot materials heated into a semi-molten state and then heating the same in a screw extruder as disclosed in Japanese Patent No. 2832625 or Japanese Laid-Open Hei 9-108805.

Since the starting materials are solid metals, any of the methods described above involves a problem that abrasion or flexion occurs violently in the upstream of the extrusion screw and a load torque has to be increased or a heating and stirring channel has to be enlarged in the screw extruder thereby making the size of the apparatus larger.

Further, since the solid material and the semi-solidified slurry are existed together in the axial direction of the extruder, metering upon extrusion tends to be instable. Further pores are liable to be mixed in molding products due to involvement of an inert gas to result in defective products.

In order to overcome the foregoing disadvantages, it has been proposed a method of cooling a molten metal in a vertical chamber under shearing by an extrusion screw into a semi-solidified slurry and then injecting the semi-solidified slurry discharged from a discharge port at the lower end of the chamber into a molding die (rheo-molding method: refer to International Patent Publication Hei 9-508850).

However, since the discharge port at the lower end of the vertical chamber is directly connected detachably to an upper portion of a molding die disposed therebelow, this method involves a drawback that the height of the entire apparatus is excessively large to increase the machine cost and also increases the maintenance cost.

In particular, in a case where the molding die is enlarged along with the enlargement of the size of molding products, it is necessary to locate a driving system such as a motor and a cylinder connected to the upper portion of the screw extruder and a storage hopper for the molten metal further higher, and such arrangement is extremely instable as a casting facility for actual operation.

Further, in the injection molding system described above, since the slurry is injected by rapidly lowering the extrusion screw in the material in which the liquid phase and the semi-solidification phase are mixed together, this involves an inherent problem that a screw flight is abraded violently and the slurry deposited in the upper portion of the screw tends to damage the shaft seal portion.

On the other hand, in the system separating an injection plunger described in Japanese Patent Laid-Open Hei 9-103859, since the nozzle at the top of the injection plunger is directed horizontally, when the nozzle is connected to the side of a molding die, the height for the entire apparatus can be reduced to some extent compared with the injection molding system described in the International Patent Publication Hei 9-508859.

However, in the system with a separated injection plunger described above, since a large melting furnace (feeder 20 with heater 25 shown in FIG. 1 of Japanese Laid-Open Hei 9-103859) is connected directly to an upper portion of the chamber, there is a limit for making the compact machine. Further, since a melting furnace for heating the solid material into a molten metal is directly connected to the upper portion of the chamber in this system, it is not favorable in view of the thermal stability of the molten metal and the safety. Further, when the melting furnace is connected to the upper portion of the chamber, it results in an inherent problem that the flow rate control is difficult

SUMMARY OF THE INVENTION

An object of the present invention is to provide a method of and an apparatus for injection molding, capable of injection molding light metal molding products at high quality with less pores or shrinkage, without excessively enlarging the size of the height for the injection molding machine.

The apparatus according to the present invention is an injection molding machine adapted to cool a molten metal under shearing by an extrusion screw into a semi-solidified slurry in a substantially vertical chamber and then inject the semi-solidified slurry discharged from the port at the lower end of the chamber into molding dies, in which a clamping device is adapted to open/close a movable die relative to a stationary die in a horizontal direction, and a connection component having a first channel in a vertical direction and a second channel extending horizontally from the lower end of the first channel and in communication with the stationary mold formed at the inside is connected to a discharge port at the lower end of the chamber.

The vertical direction of the first channel means a direction substantially vertical to the moving direction of the movable die.

In this case, since the semi-solidified slurry discharged from the discharge port at the lower end of the chamber is once turned into the horizontal direction and then injected into the molding dies opening/closing in the horizontal direction, even when the molding is enlarged or the stroke amount is increased, it is no more necessary to locate the screw extruder at a higher position.

Further, in the apparatus according to the present invention, since the molten metal is cooled under shearing by the extrusion screw into the semi-solidified slurry in the vertical chamber, various disadvantages caused by the heating of the solid material into the semi-solidified slurry can be overcome, as well as light metal molding products of high quality with less pore and shrinkage can be injection molded.

In a case where the screw extruder has an injection function of axially moving the extrusion screw to inject the semi-solidified slurry, there is no requirement of disposing an injection plunger in the second channel of the injection flow channel, and the injection flow channel can be formed into a substantially L-shaped flow channel consisting of the first channel and the second channel.

In this case, if a crossing portion between the first channel and the second channel is formed as a rounded part for smoothly turning the direction of the semi-solidified slurry, the semi-solidified slurry can be injected smoothly in the horizontal direction by the downward movement of the extrusion screw.

On the other hand, in a case where the screw extruder has an extrusion screw not moving in the axial direction and, accordingly, the extruder has no injection function of injecting the semi-solidified slurry, an injection plunger moving in the horizontal direction may be disposed in the second channel of the injection flow channel. In this case, when a check valve for inhibiting the back flow of the semi-solidified slurry in the second channel to the screw extruder is disposed to the first channel, metering for one shot of the material upon injection molding can be conducted accurately.

Further, the apparatus according to the present invention may comprise a melting furnace located substantially at the same ground level as the clamping device for heating the solid material into the molten metal and a molten metal supply unit for supplying the molten metal in the melting furnace by way of a supply pipeline shielded with an inert gas into a storage hopper.

In this case, since the molten metal in the melting furnace located substantially at the same ground level as the clamping device is supplied by way of the supply pipeline to the hopper which is stored the molten metal temporarily, a molten metal by a required amount corresponding to the cycle time can be supplied to the hopper, so that it is no more necessary to locate a great amount of the molten metal at a top position in the apparatus, which is preferred in view of safety.

Further, the melting furnace preferably has an induction heating type heating device for instantly melting the solid material, by which the melting furnace can be made compact, and it is extremely safe compared with the prior apparatus such as shown in FIG. 1 of Japanese Laid-Open Hei 9-103859 in which the molten metal has to be stored always in a great amount in a molten state.

Further, the apparatus according to the present invention preferably comprises a level sensor for detecting the height of the surface of the molten metal in the hopper and a control device for controlling the amount of the molten metal supplied to the hopper based on the signal from the sensor such that the surface height of the molten metal is not higher than the position for the shaft seal of the extrusion screw.

In this case, since the surface of the molten metal in the chamber does not exceed the position of the shaft seal, even if a semi-solidified slurry is deposited to the upper portion of the extrusion screw, the slurry can be prevented as much as possible from reaching the shaft seal, thereby making the shaft seal less damaged.

Preferably, the extrusion screw comprises a central shaft inserted rotatably into the chamber and a plurality of screw segments arranged in the axial direction.

In this embodiment, if any one of the segments suffers from abrasion and melting damage by both the molten metal and semi-solidified slurry, only the portion of the extrusion screw that abraded or damaged can be replaced easily by merely replacing the degraded segment with a spare segment or an intact segment of an identical shape already used at other position, of the screw and it is no more necessary to entirely replace the extrusion screw.

Further, since the extrusion screw is divisionally constituted with a plurality of screw segments, the surface of screw segment can be improved for the abrasion and melting damage at a reduced cost. And the surface of extrusion screw can be optimized, in view of the material, suitably depending on the material of the light metal alloy to be injection molded.

It is preferred to use a plurality of screw segments each having a compression ratio of 1.0 and an identical axial length.

In this case, since a plurality of segments arranged in the axial direction in one extrusion screw can be replaced optionally with each other, the life of the extrusion screw can be increased remarkably at a reduced cost in a screw extruder providing that abrasion and melting damage occurs at substantially fixed portions such as in a case of extruders used for the injection molding of light metal alloys.

For instance, in a screw extruder making a molten metal or a semi-solidified slurry from heating a solid metal as described above, since abrasion occurs more violently in the upstream exposed to the solid metal compared with the downstream of the extrusion screw, the life of the extrusion screw can be extended by replacing a segment at the upstream suffering from abrasion to a certain extent with a segment at the downstream suffering from less abrasion.

On the other hand, in a screw extruder making a semi-solidified slurry from cooling a molten metal, since abrasion occurs most violently in a portion of the extrusion screw where the dendritic crystals starts to grow, the life of the extrusion screw can be extended by replacing a screw segment at a portion suffering from abrasion to a certain extent with a segment in other portion suffering from less abrasion or melting damage.

Further, when the extrusion screw comprises a central shaft and a plurality of axially arranged screws fitted over the outer circumferential surface of the central shaft, it is possible to design an extrusion screw of high performance corresponding to various extrusion conditions.

For example, when a metal material of high temperature creep strength is used for the central shaft and a material of excellent resistance against melting damage caused by the molten metal or the semi-solidified slurry is used for the plurality of segments, an extrusion screw excellent in both of the performances of them can be obtained.

That is, since Fe series stainless steel (Cr 12% steel and the like) or Incoloy 800 (Fe—Ni—Cr series) is excellent for the high temperature creep characteristic over tool steels at a high temperature of about 600° C., such materials are suitable to the central shaft.

On the other hand, the molten metal or semi-solidified slurry of Al alloys gives remarkable melting damage to the iron based materials as described above and, if such iron based materials are used as they are for the screw segment, it is necessary to replace the segments in about one week.

In view of the above, for the plurality of segments fitted over the central shaft, it is preferred to use a material having excellent resistance against melting damage by itself, or a material showing excellent resistance melting damage by ceramic coating applied at the surface thereby reducing the frequency of replacement.

Further, the injection molding apparatus for light metal alloys according to the present invention preferably comprises a metering cylinder having an axially moving injection plunger at the inside, a temperature control unit for setting the temperature such that the light metal alloy material in the cylinder is formed into a semi-solidified slurry and a nozzle connected at the base end to the discharge port of the metering cylinder and formed with a discharge port at the distal end, in which a static mixer for radially mixing the semi-solidified slurry passing through the nozzle is disposed in the nozzle.

In this embodiment, since the semi-solidified slurry is injected while being mixed radially in the nozzle into a molding plate, even if a portion of solid particles in the slurry grows coarsely, the solid particles are refined again when they pass through the nozzle.

This can prevent grown solid particles from mixing into molding products, to improve the quality of the molding products and prevent the grown solid particles from clogging the nozzle to hinder the closure of an on/off valve or increase the resistance to the passage of the light metal alloy material and enables stable molding operation.

The static mixer described above is preferably constituted with stirring blades each formed in a shape twisted around the axial center of the nozzle. In this case, it is preferred that a plurality of stirring blades of different twisting directions are arranged axially in the nozzle while crossing to each other. This is because the direction of the radial mixing of the semi-solidified slurry changes on every passage through the stirring blades of different twisting directions to further improve the refining function for the grown solid particles.

When the solid phase rate of the light metal alloy increases in a portion of the nozzle corresponding to the mixer, it may be a worry that the solid particles clog to the periphery of the mixer and can not be injected. For avoiding this, it is preferred to provide a heating member for setting the temperature of the light metal alloy at a portion corresponding to the mixer to a temperature higher than the liquidus temperature.

On the other hand, if the entire nozzle is heated to a temperature higher than the liquidus temperature, this may increase the liquidus phase not only in the nozzle but also in the metering cylinder to possibly worsen the quality of molding products by the lowering of the solid phase rate of the semi-solidified slurry in the cylinder. Then, for preventing fluctuation of the solid phase rate caused by heating of the nozzle, it is preferred to provide a heating member for setting the temperature of the light metal alloy to a semi-solidification temperature at a portion in the nozzle upstream to the mixer.

Such a heating member can be adapted to both of the solid plug nozzle or self-closure type nozzle described above. In the former, a temperature setting member for forming the solid plug may be disposed to a discharge port of the nozzle. In the latter, an on/off valve for opening/closing the discharge port of the nozzle may be disposed in a portion of the nozzle downstream to the mixer.

Further, the injection molding apparatus for light metal alloys according to the present invention preferably comprises a metering cylinder having an axially moving injection plunger at the inside, a temperature control unit for setting the temperature of the light metal alloy material in the cylinder so as to transform the same into a semi-solidified slurry and a nozzle connected at a base end to a discharge port of the metering cylinder and a discharge port formed at the distal end thereof in which a slitwise injection channel causing a shearing flow to the semi-solidified slurry passing through the nozzle is disposed in the nozzle.

In this embodiment, since the semi-solidified slurry is injected into the molding die while forming a shearing flow in the slitwise injection channel of the nozzle, even if a portion of the solid particles in the semi-solidified slurry is grown coarsely, such solid particles are refined when they pass through the nozzle.

Therefore, this can prevent grown solid particles from mixing into molding products to improve the quality of the products, and the grown solid particles from clogging the nozzle to hinder the closure of the on/off valve or increase the resistance to the passage of the light metal alloy material, and enables stable molding operation.

DETAILED DESCRIPTION OF THE PREFERRED EMBODIMENTS

The present invention is to be explained by way of preferred embodiments with reference to the drawings.

Figure 1:
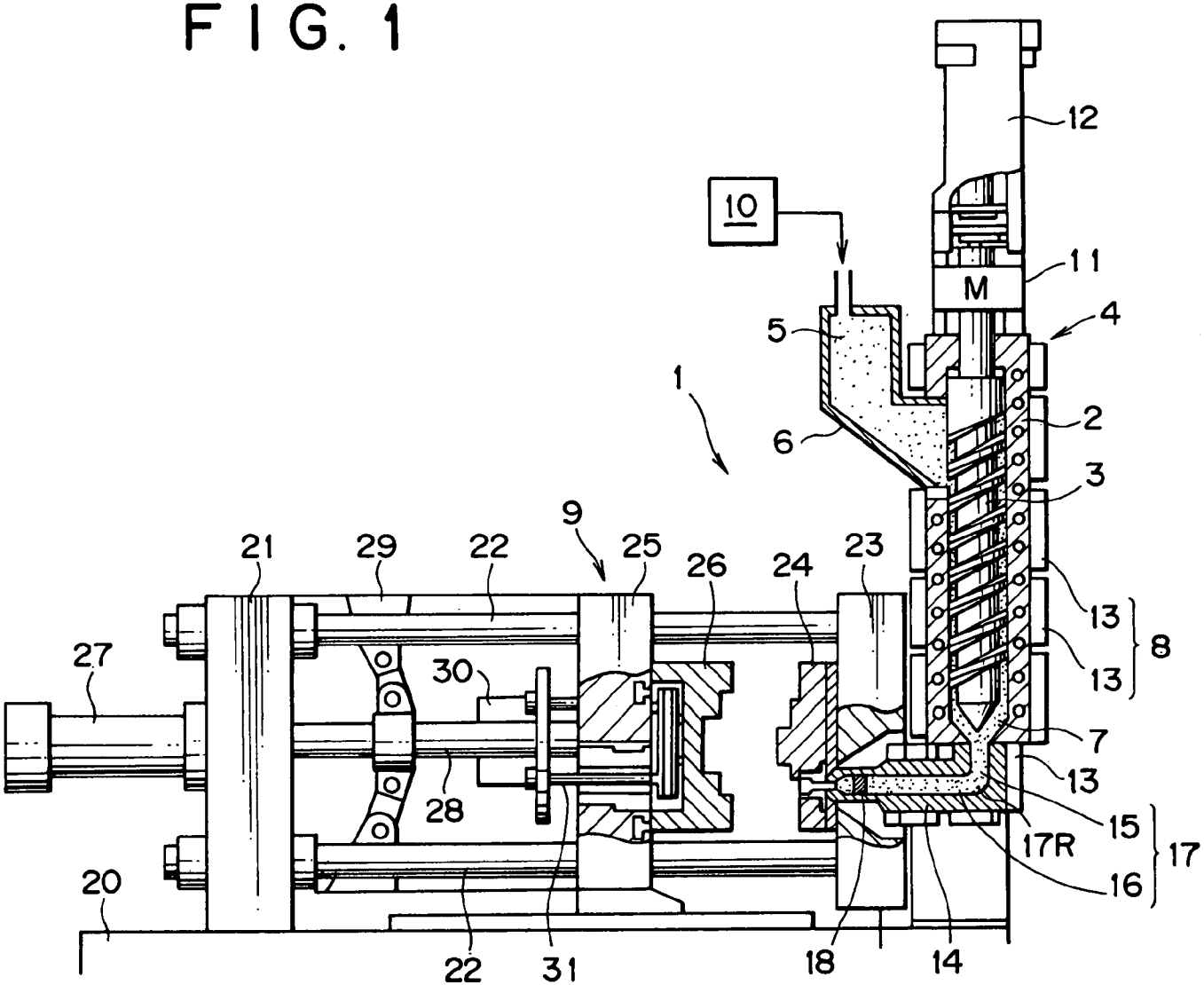
FIG. 1 is an entire side elevational view of an injection molding apparatus according to a first embodiment of the present invention.

FIG. 1 shows a first embodiment of the present invention.

An injection molding apparatus 1 for light metal alloys according to this embodiment comprises a screw extruder 4 disposed vertically and having an extrusion screw 3 disposed rotatably at the inside of a chamber 2 and a hopper 6 connected to the upper end of the chamber 2 for storing molten metal 5.

Further, the apparatus 1 comprises a temperature control unit 8 used for temperature control, for example, cooling such that the molten metal 5 supplied from the hopper 6 into the chamber 2 is formed into semi-solidified slurry 7 and a clamping device 9 into which the semi-solidified slurry 7 discharged from a discharge port at a lower end of the chamber 2 is injected.

Among the constituent components of the apparatus 1, the hopper 6 is adapted to receive the molten metal 5 melted in a melting furnace 10 and store the same in a molten state, and a lower end opening of the hopper 6 is connected to an upper end of the chamber 2.

Further, a sealing unit (not illustrated) for blowing an inert gas such as argon from the lower portion of the hopper 6 is connected to the bottom of the hopper 6 and the molten metal 5 in the hopper 6 is bubbled by inert gas from the sealing unit to remove impurities and seal the surface of the molten metal 5 with the inert gas.

A driving motor 11 is coupled directly to the upper end of the chamber 2, an upper end of the extrusion screw 3 inserted rotatably in the chamber 2 is connected to the driving shaft of the motor 11, and the screw 3 is disposed in a cantilever manner such that its lower end constitutes a free end in the chamber 2.

An injection cylinder 12 having a vertically protruding and retracting cylinder rod is connected to an upper portion of the motor 11, and the motor 11 is coupled directly to the cylinder rod of the cylinder 12.

Therefore, in the screw extruder 4 in this embodiment, the screw 3 is axially moved downwardly by way of the motor 11 by downwardly protruding the cylinder rod of the injection cylinder 12, by which the semi-solidified slurry 7 accumulated at the lower end in the chamber 2 can be injected to the outside.

The outer circumferential surface of the chamber 2 is covered with the temperature control unit 8, and the temperature control unit 8 comprises a plurality of temperature control jackets 13 each separated in the vertical direction. Then, a heat medium such as an oil at a temperature lower than the molten metal 5 is caused to flow in the jacket 13, so that the molten metal 5 in the chamber 2 can be cooled to a temperature range lower than the liquidus temperature and higher than the solidus temperature.

Further, for controlling the temperature of the molten metal 5 in the chamber 2 at high accuracy, each of the temperature control jackets 13 also has a heating function.

A substantially L-shaped connection pipeline (connection member) 14 is connected to the discharge port at the lower end of the chamber 2 and the pipeline 14 has, at the inside, an injection flow channel 17 comprising a first channel 16 in the vertical direction and a second channel 16 extending horizontally from the lower end of the channel 15. Among them, the upper end of the first channel 15 is connected with the discharge port at the lower end of the chamber 2, while the exit of the second channel 16 is connected with a stationary plate 24 secured to a fixed base 23 of a mold clamping device 9 to be described later.

In this embodiment, an a rounded portion 17R is formed at a joined portion between the first channel 15 and the second channel 16 for smoothly turning the direction of the semi-solidified slurry 7, by which the semi-solidified slurry 6 can be injected horizontally by the downward movement of the extrusion screw 3.

Further, the temperature control jacket 13 is also disposed to the outer circumferential surface of the connection pipeline 14 for keeping the semi-solidified slurry 7 at the inside to a constant temperature.

A nozzle 18 always closed except for injection step is disposed at the exit of the second channel 16. The nozzle 18 may be adapted to form a solid metal plug at the top end of the nozzle by a temperature control unit comprising a temperature control jacket 13 disposed to the outer circumference thereof for closing the nozzle or adapted to close the nozzle by a mechanical or spring type shut-off valve disposed to the top end of the nozzle.

The latter type nozzle using the shut-off valve is suitable in that a portion of high solid phase rate is not formed near the top end of the nozzle upon forming the solid metal plug and there is no possibility that the solid plug intrudes into the products.

Further, as shown in FIGS. 5A to 6B, the extrusion screw 3 preferably comprises a central shaft 41 rotationally inserted into the chamber 2 and a plurality of axially arranged screw segments 42 fitted over the outer circumferential surface of the shaft 41.

The shaft 41 comprises a cylindrical shaft member having an involute spline 43 formed on the outer circumferential surface. The shaft 41 is constituted with a metal material having excellent high temperature creep characteristics over tool steels, for example, comprising Fe based stainless steels (Cr 12% steel and the like) or Incoloy 800 (Fe—Ni—Cr series).

A conical tip segment 44 of a diameter larger than that of the shaft 41 is screw coupled to the top end face of the shaft 41, and a base end segment 45 of a large diameter coaxially connected with a driving shaft of the driving motor 11 is screw coupled with the base end face of the shaft 41. The segments 42 are secured so as not to be moved relatively to the central shaft 41 by axially clamping a plurality of segments 42 arranged axially intimately to each other by the segments 44 and 45.

Figure 5A:
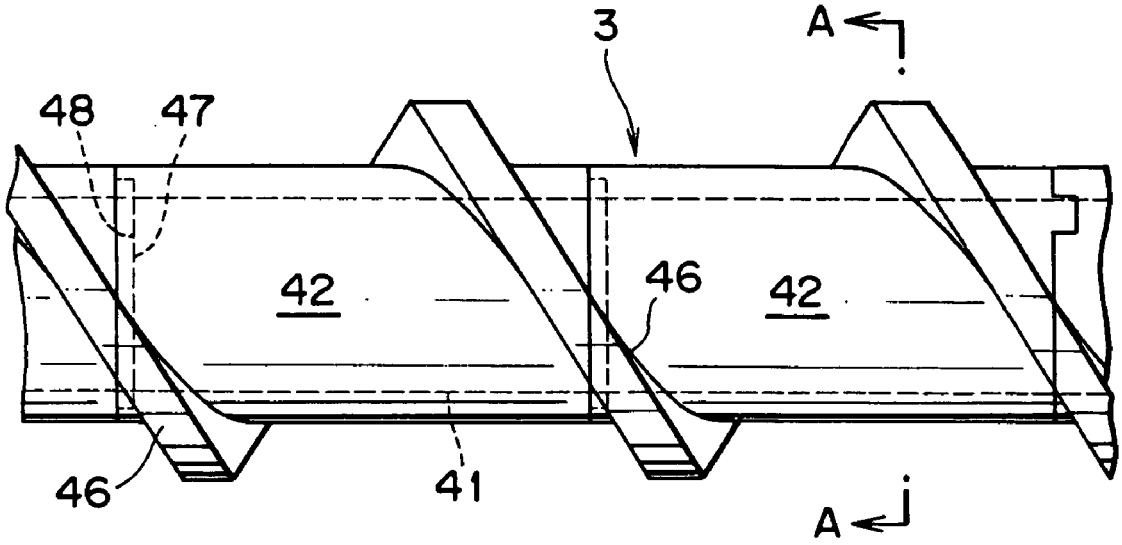
FIG. 5A is a side elevational view of an extrusion screw enlarged in an axial midway part.
Figure 5B:
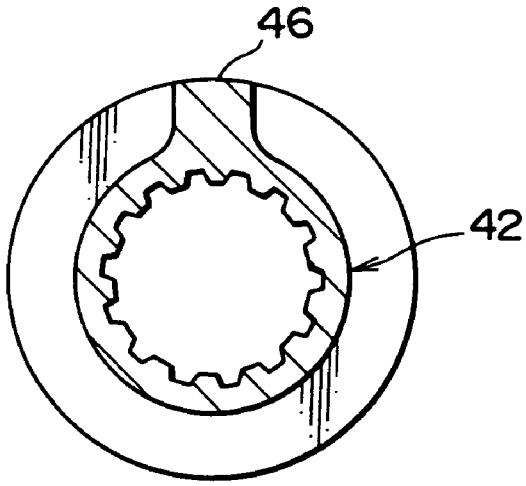
FIG. 5B is a cross sectional view taken along line A—A in FIG. 5A.
Figure 6A:
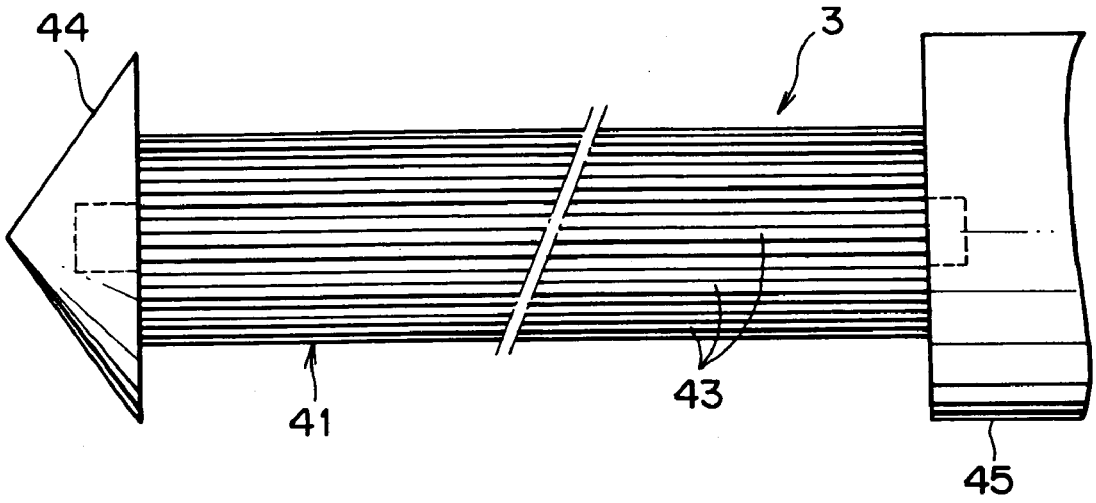
FIG. 6A is a side elevational view for a central shaft of an extrusion screw.
Figure 6B:
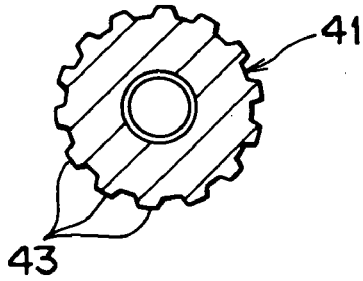
FIG. 6B is a transversal cross sectional view thereof.

As shown in FIGS. 5A and 5B, each of the segments 42 is formed into a short cylindrical shape which is opened at both axial ends and has a screw blade 46 on the outer circumferential surface and inner circumferential surface fitting to the involute spline 43 of the central shaft 41. Respective segments 42 are axially arranged such that the screw blades 46 are in contiguous with each other between each of the adjacent segments 42.

Further, each of the segments 42 has a compression ratio of 1.0, an identical cross sectional shape at an optional axial direction and an identical axial size. Therefore, a plurality of segments 42 arranged axially in one extrusion screw 3 are adapted to be replaceable with each other.

Each of the segments 42 is made of a material applied with ceramic coating or the like to the surface and having excellent resistance to melting damage thereby decreasing the frequency of replacement.

Further, each of the segments 42 has a convex nest 47 formed at an axial end face for fitting to a concave nest 48 of an adjacent segment 42, and fitting of the nests 47 and 48 to each other can prevent light metal alloy from leaking through the gap between each of the segments 42 to the central shaft portion 41.

The anti-rotation stop for each segment 42 to the central shaft portion 41 may be attained by a key and a key slot.

Then, the clamping device 9 comprises a link housing 21 disposed vertically on a substrate 20, a stationary base 23 fixed to the housing 21 by way of horizontal tie bars 22, a stationary plate 24 fixed to the stationary base 23, a movable base 25 supported slidably to the tie bars 22 passing therethrough and a movable plate 26 secured to the movable base 25 such that it can be opened/closed horizontally relative to the stationary plate 24.

A clamping cylinder 27 is secured at the central portion on the outer surface of the link housing 21 and the top end of the cylinder rod 28 of the cylinder 27 is connected with a central portion of the movable base 25. The housing 21 and the movable base 25 are connected by way of a plurality of links 29 which are folded when the housing and the movable base approach to each other, and are arranged substantially linearly in a horizontal direction when they apart from each other.

A push cylinder 30 is disposed to the movable base 25 on the side facing the housing 21 and an push rod 31 of the cylinder 30 is passed through the movable base 25 and connected with the movable plate 26.

Accordingly, in the clamping device 9, the movable plate 26 can be urged strongly to the movable plate 24 by protruding the cylinder rod 28 of the clamping cylinder 27 to straighten the link 29 on one line and protruding the push rod 31 of the push cylinder 30 in a straightened state of the link 29.

Then the operation of the injection molding apparatus 1 and the method of injection molding the light metal alloy using the same are to be explained.

At first, molten metal 5 charged from an induction heating type melting furnace 10 by means of a mechanical or solenoid pump into the hopper 6 is supplied in a gas shield state to an upper portion of the chamber 2 of the screw extruder 4, cooled by each of the temperature control jackets 13 below the liquidus temperature and above the solidus temperature and grown dendritically. The dendritic crystals are pulverized by shearing action of the extrusion screw 3 and fine crystal grains are formed and transformed into the semi-solidified slurry 7.

Subsequently, the slurry 7 is downwardly extruded by the extrusion screw 3 under temperature control in the same manner as a slurry pump. In this case, since the nozzle 18 for the connection pipeline 14 is closed, the extrusion screw 3 undergoes an axial upward load by the extruding force by the rotation of the screw per se.

On the other hand, a predetermined back pressure is set for the injection cylinder 12 of the screw extruder 4 and, when an inner pressure overcoming the back pressure is formed in the chamber 2, the extrusion screw 3 upwardly moves in the axial direction and the semi-solidified slurry 7 is accumulated at the lower end of the chamber 2 and metered by a predetermined amount.

In this case, even the semi-solidified slurry 7 has an extremely low viscosity compared with a synthetic resin or the like, so that metering for a predetermined amount has to be conducted by compulsorily moving the extrusion screw 3 upwardly by a back pressure to the injection cylinder 12 depending on the viscosity of the slurry 7.

In this way, when the semi-solidified slurry 7 has been metered, upward movement and rotation of the extrusion screw 3 are stopped and the injection cylinder 12 downwardly moves the screw 3 all at once. By the downward movement of the screw 3, the metered semi-solidified slurry 7 accumulated at the lower end of the chamber 2 is injected by way of the injection flow channel 17 of the connection pipeline 14 into the cavity of the molding plates (stationary plate 24 and the movable plate 26) and molded into a predetermined shape.

According to the injection molding method of the present invention as described above, since the semi-solidified slurry 7 is formed starting from the molten metal 5, it forms a tissue in which fine crystal grains are dispersed uniformly, and molding products of high quality excellent in mechanical characteristics and with less burrs can be obtained.

That is, in the method of the present invention, since the molten metal 5 is formed into the semi-solidified slurry 7 in the vertical chamber 2, the molten metal 5 is formed into the slurry 7 after the inert gas the molten metal 5 is formed into the slurry 7 after the inert gas contained in the molten metal 5 has been driven off by the pressure and the buoyancy. Accordingly, mixing of pores into the molding products due to involvement of the inert gas can be prevented, thereby preventing occurrence of defective products as less as possible.

Further, since the starting material is the molten metal 5, which is transported downwardly under cooling into the semi-solidified slurry 7, abrasion or flexion in the upper stream of the extrusion screw 3 can be reduced and it is no more necessary to increase the load torque and enlarge the stirring route of the screw extruder 3 so much, and the apparatus can be made compact.

Further, since the semi-solidified slurry 7 injected from the discharge port at the lower end of the chamber 2 is once turned into the horizontal direction and then injected into the molding plates 24 and 26 that are opened/closed in the horizontal direction, there is no-requirement for locating the screw extruder 4 to an unnecessarily high level, irrespective of the molding plates 24, 26 and the extent of the stroke amount thereof. Accordingly, light metal molding products of high equality with less pore or shrinkage can be injection molded without setting the size for the height of the entire apparatus excessively large.

By the way, it is considered that in this embodiment, a portion in the extrusion screw 3 that dendritic crystals start to grow most suffers from abrasion or melting damage in a case of using the screw extruder 4 adapted to cool the molten metal 5 into the semi-solidified slurry 7.

In view of the above, when abrasion or the like should occur exceeding a predetermined level to the screw segment 42 corresponding to the portion, the segment can be replaced with a segment 42 with less abrasion at other portion thereby remarkably extending the life of the extrusion screw 3. It is of course possible to replace only the damaged segment 42 with a quite new segment.

Figure 2:
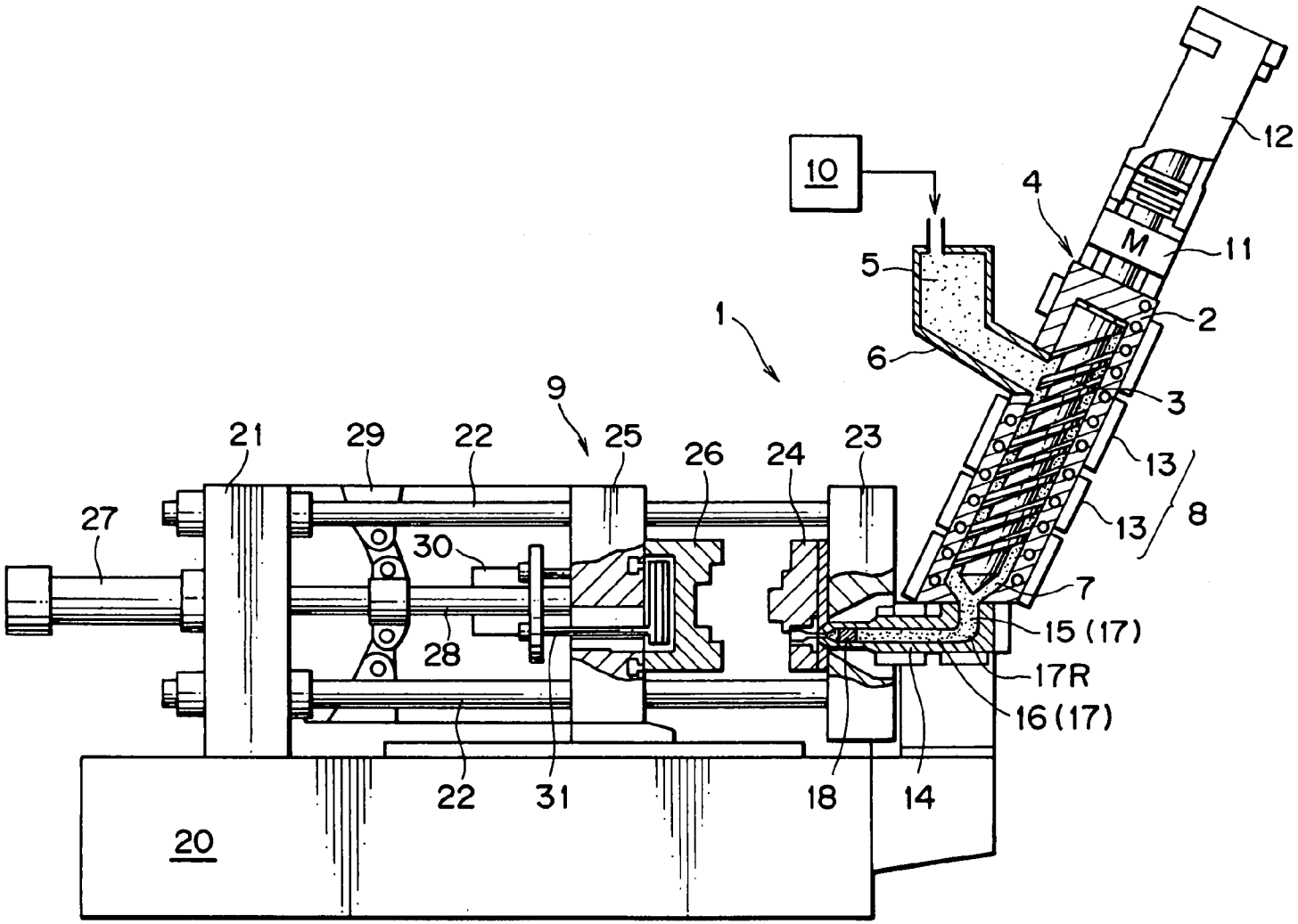
FIG. 2 is an entire side elevational view of an injection molding apparatus according to a second embodiment of the present invention.

FIG. 2 shows a second embodiment of the present invention.

In this embodiment, a chamber 2 for a screw extruder 4 is inclined in a state somewhat turned down to the side opposite to the clamping device 9, by which the height for the entire apparatus can be suppressed further lower compared with the case of the first embodiment.

The degree of inclination of the screw extruder 4 is set substantially equal with the helical angle of the extrusion screw 3 and, at such degree of inclination satisfactory stable operation can be conducted without removing the pores at the inside of the chamber 2 or without deposition of the semi-solidified slurry 7 to the upper portion of the shaft.

In the present invention, "substantially vertical" means not only that the chamber 2 is disposed vertically but also that it is inclined to such an extent as removal of bubbles can be saved at the inside of the chamber 2 or deposition does not occur to the upper portion of the shaft.

Since other constitutions and functions are identical with those in the first embodiment, corresponding portions are shown by identical references in the drawing and detailed explanations for them are to be omitted.

Figure 3:
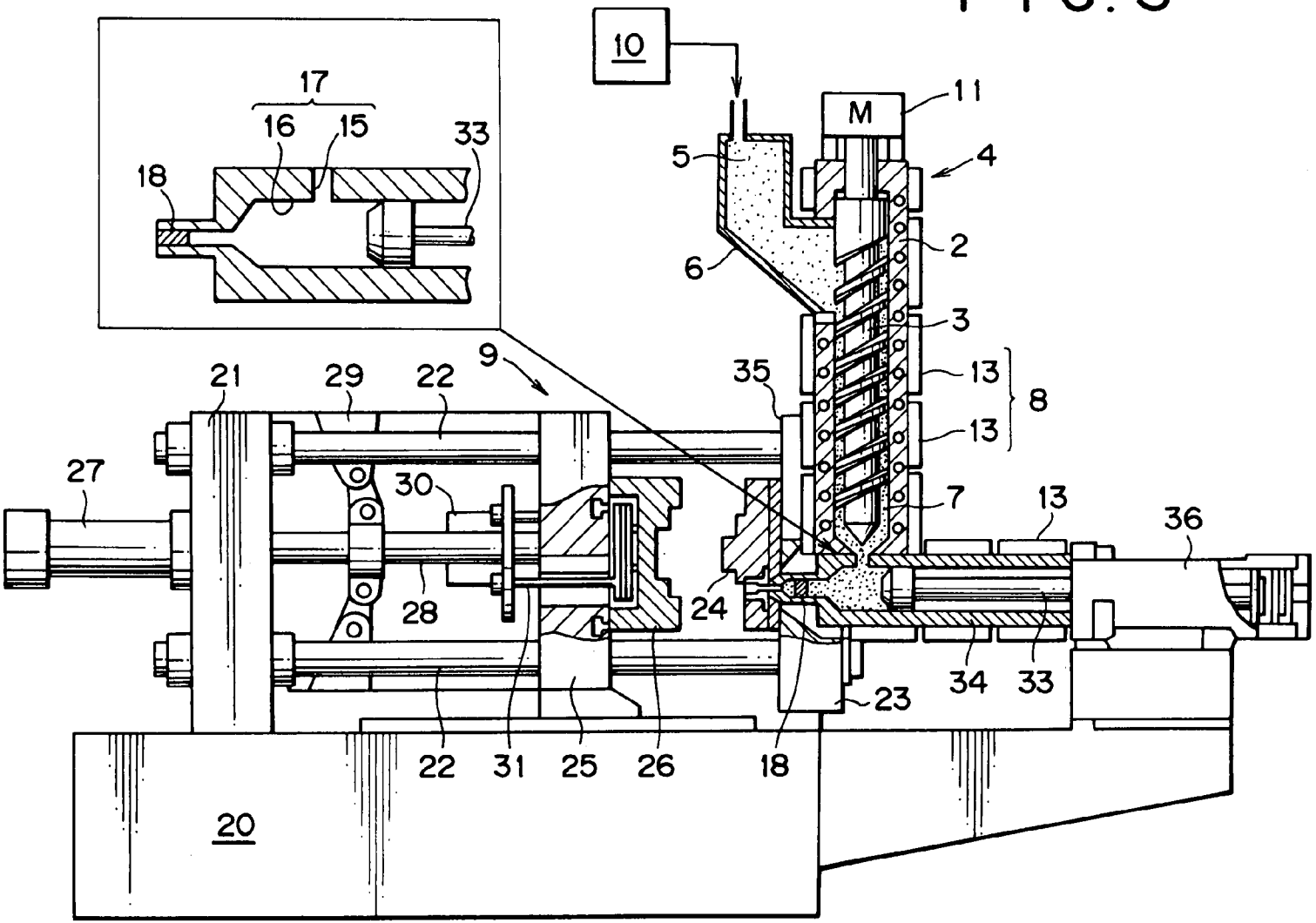
FIG. 3 is an entire side elevational view of an injection molding apparatus according to a third embodiment of the present invention.

FIG. 3 shows a third embodiment of the present invention.

In this embodiment, an extrusion screw 3 is inserted in a chamber 2 so as not to move in the axial, namely, vertical direction, so that the injection cylinder 12 is not disposed to the upper end of a driving motor 11.

Instead, a discharge port at the lower end of a chamber 2 is connected with an upper portion at the front end of a metering cylinder (connection member) 34, in which an injection plunger 33 protruding and retracting horizontally is inserted therein. An injection flow channel 17 comprising a vertical first channel 15 and a horizontal second channel 16 is constituted at the front end of the metering cylinder 34, and a check valve (not illustrated) for preventing the semi-solidified slurry 7 in the second channel 16 from flowing backwardly to the chamber 2 is disposed in the first channel 16.

Further, an injection cylinder 36 is disposed to the rear end of the metering cylinder 34 for protruding an injection plunger 33 toward a stationary plate 24. Therefore, in the injection molding apparatus 1 described above, semi-solidified slurry 7 can be injection into molding plates 24 and 26 by accumulating a predetermined amount of the semi-solidified slurry 7 in the second channel 16 of the metering cylinder 34 and then protruding the injection plunger 33 all at once.

According to this embodiment, since the semi-solidified slurry 7 in the second channel 16 is injected in the horizontal direction by the injection plunger 33 for horizontal injecting, there is no more necessary to provide the injection cylinder 12 to the upper portion of the screw extruder 4 and the height of the entire apparatus can be lowered further compared with the case of the first embodiment.

Further, as shown in FIG. 3, in this embodiment, the chamber 2 for the screw extruder 4 is buried in an inner hollow portion 35 formed by recessing a central portion of a stationary base 23 of a clamping device 9 so as to prevent increase in the length of the apparatus as less as possible due to the use of the horizontal injection plunger 33.

Further, in this embodiment, the following function and effect can also be provided in addition to those of the first and the second embodiments.

That is, in this embodiment, since the semi-solidified slurry is injected by the injection plunger 33 different from the extrusion screw 3, there is no requirement for moving the extrusion screw 3 at high speed for injecting the slurry as in the case of the first and the second embodiments. This can prevent abrasion at top end of the screw 3 caused by high speed movement of the screw 3 and, if the plunger 3 should be abraded, only the inexpensive plunger 33 has to be replaced.

Further, in the in-line system, even if the chamber 2 is arranged vertically, there is a worry that the slurry more or less invades into a shaft seal by the axial movement of the extrusion screw 3. In this embodiment, since there is no requirement for the axial movement of the extrusion screw 3, the shaft seal can be located at a position not so high from the molten surface of the molten metal 5.

Accordingly, in this embodiment, the height for the location of the driving motor 11 can be set lower, as well as, there is no requirement of disposing the injection cylinder 12, so that the height for the entire apparatus can be reduced further lower. Accordingly, compared with the first and the second embodiments, the safety of the facility can be improved and the maintenance can be facilitated.

Figure 4:
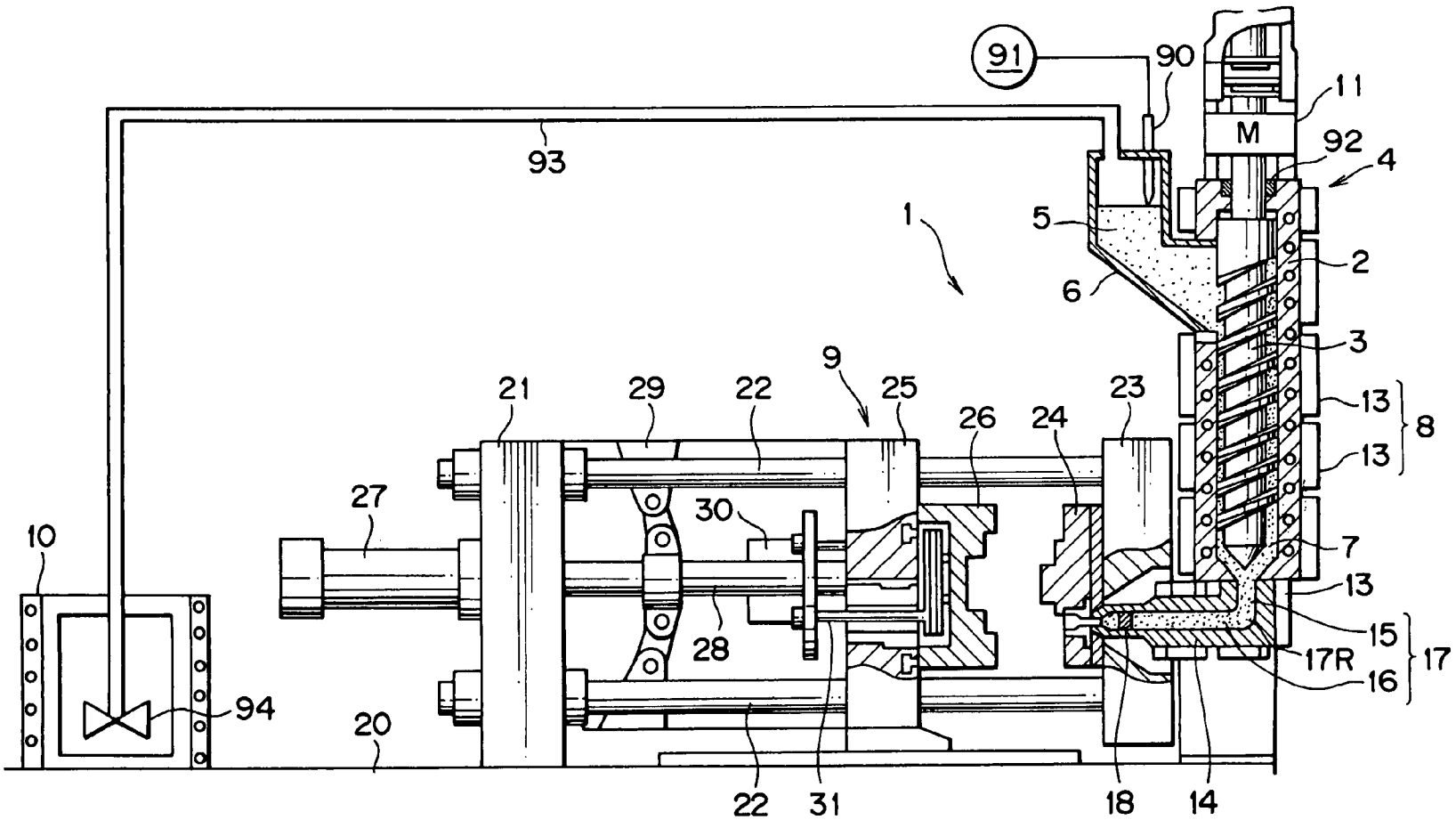
FIG. 4 is an entire side elevational view of an injection molding apparatus according to a fourth embodiment of the present invention.

FIG. 4 is a fourth embodiment according to the present invention.

An injection molding apparatus 1 of this embodiment has a melting furnace 10 located substantially at the same ground level as a clamping device 9 for heating a solid material into a molten metal 5 and the melting furnace 10 has a function of melting the metal material at the inside by a well-known induction heating method briefly into a liquid phase.

A molten metal supply unit 94 comprising, for example, a screw pump or a solenoid pump is disposed to the inside of the melting furnace 10, and the supply unit 94 is connected by way of a pipeline 93 to a hopper 6 on the side of a screw extruder 4. The pipeline 93 has an inner and outer double tube structure, in which a space between the outer tube and the inner tube is filled with an inert gas thereby sealing the molten metal in the inner tube with the inert gas to prevent oxidation of the molten metal 5.

As described above, since the melting furnace 10 is located substantially at the same ground level as the clamping device 9 and the molten metal 5 in the melting furnace 10 is supplied by way of the supply pipeline to the hopper 6, it is not necessary to locate a great amount of the molten metal 5 at a high place of the apparatus which is preferred in view of safety.

Further, the injection molding apparatus 1 of this embodiment comprises a level sensor 90 for detecting the surface height of the molten metal 5, and a control device 91 for controlling the supply of the material by the molten metal supply unit 94 based on signals from the sensor 90, and the detected surface height of the sensor 90 is set lower than the shaft seal 92 of the extrusion screw 3.

A thermocouple or a supersonic sensor may be used for the level sensor 90. Further, a system of controlling the supply of the material by opening/closing a solenoid valve (not illustrated) disposed to the midway of the supply pipeline 93 by the control device 91 may be adopted.

As described above, since the surface height of the molten metal 5 in the hopper 6 is controlled by the control device 91 so as not to be higher than the shaft seal of the extrusion screw 3, the water head of the material in the chamber 2 does not exceed the shaft seal 92. Accordingly, even when the semi-solidified slurry 7 is deposited to an upper portion of the extrusion screw 3, the slurry 7 can be prevented from reaching the shaft seal of the screw 3 as much as possible to prevent damage for the shaft seal.

Figure 7:
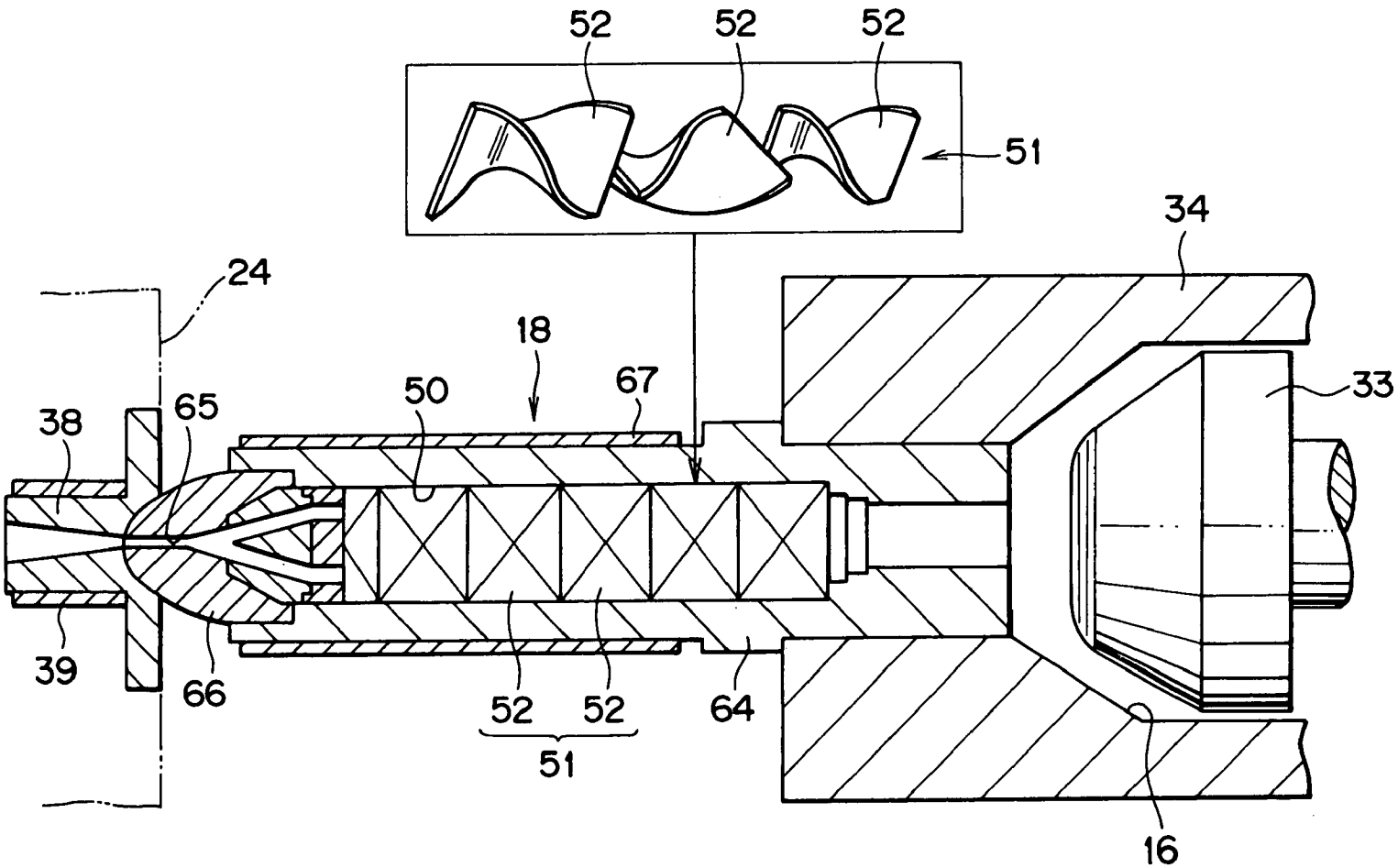
FIG. 7 is a cross sectional view of a nozzle for light metal alloy injection according to a preferred embodiment of the present invention.

FIG. 7 shows a first embodiment of a nozzle 18 for light metal alloy injection usable for the injection molding apparatus 1 shown in FIG. 3.

The nozzle 18 comprises a solid plug nozzle of forming a solid plug by solidifying the light metal alloy itself in the nozzle by cooling the top end upon metering, and the nozzle comprises a cylindrical nozzle main body 64 screw coupled at the base end to a discharge port of a metering cylinder 34, a tip member 66 having a discharge port 65 fixed in a state fitted to the top end of the nozzle main body 64 and a heating member 67 comprising a band heater or the like wound around the periphery of the nozzle main body 64.

The tip member 66 of the nozzle 18 is connected in a fitted state to a concave part of a spool bush 38 embedded in the stationary mold 24, and a temperature setting member 39 comprising a band heater or the like is wound around the periphery of the bush 38 for heating or cooling the bush 38 higher than the temperature set to the mold and lower than the solidus temperature.

Therefore, solid plug (not illustrated) can be formed in the discharge port 65 of the tip member 66 under the temperature control by the temperature setting member 39.

The nozzle 18 further has a static mixer 51 contained in an inner channel 50 of the nozzle main body 64. The mixer 51 is adapted to radially mix the semi-solidified slurry 7 passing through the inner channel 50 of the nozzle main body 64 to refine the solid particles contained in the slurry. In this embodiment, the static mixer comprises a plurality of stirring blades 52 each formed into a twisted shape around the axial center of the nozzle main body 64.

As shown in FIG. 7, the plurality of stirring blades 52 are opposite to each other with respect to the twisting direction between the blades adjacent in the axial direction of the nozzle. The stirring blades 52 of different twisting directions are arranged along the axial direction in the inner channel 50 of the nozzle main body 64 such that they are in perpendicular to each other. Further, it is preferred to dispose the stirring blades 52 by three stages or more for effectively pulverizing a grown portion of the solid phase in the semi-solidified slurry 7.

The heating member 67 is disposed in the nozzle main body 64 at a portion corresponding to the static mixer 51 for heating the light metal alloy situated at that portion to a temperature higher than the liquidus temperature. Accordingly, provision of the mixer 51 can prevent easy clogging of the solid particles in the inner channel 50 and enables stable injection operation.

Further, the heating member 67 may also comprise an induction heating member wound around the outer circumference of the nozzle main body 64, and the nozzle main body 64 constituted with a ferromagnetic material containing nickel, chromium, iron or the like. This is preferred in that the light metal alloy in the inner channel 50 can be heated instantaneously to a temperature higher than the liquidus temperature.

That is, when the inside of the nozzle main body 64 is always heated above the liquidus temperature, the heat conducts also to the semi-solidified slurry in the metering cylinder 34 to lower the solid phase rate, sometimes failing to obtain molding products of a desired quality. Heating by the use of the induction heating member heats the semi-solidified slurry 7 in the inner channel 50 temporarily to a temperature higher than the liquidus temperature only just before the injection, and this can suppress the fluctuation of the solid phase rate of the semi-solidified slurry 7 in the metering cylinder 34 to effectively present degradation of the quality due to heating of the nozzle.

The effect of applying the nozzle 18 to the injection molding apparatus shown in FIG. 3 is next to be explained.

At first, the molten metal 5 charged from the melting furnace 10 by a mechanical or solenoid pump into the hopper 6 is supplied in a gas shield state to the upper portion of the chamber 2 of the screw extruder, and cooled by each of the temperature control jackets 13 to a temperature lower than the liquidus temperature and higher than the solidus temperature and grown into dendritic crystals.

The dendritic crystals are pulverized by the shearing action of the rotating extrusion cylinder 3 and fine crystal grains are formed and then transformed into the semi-solidified slurry 7.

Subsequently, the slurry 7 is downwardly extruded by the extrusion screw 3 under temperature control like that the slurry pump. In this step, since the on/off valve for the nozzle 18 is closed, the injection plunger 33 is backwardly loaded in the axial direction (rightward in FIG. 3) by the extrusion force caused by the rotation of the extrusion screw 2.

On the other hand, a predetermined back pressure is set to the injection cylinder 36 and when an inner pressure overcoming the back pressure is generated in the metering cylinder 34, the injection cylinder 36 backwardly moves axially and the semi-solidified slurry 7 is accumulated at the front end of the metering cylinder 34.

Then, when it is detected that the injection plunger 33 has reached a predetermined measuring position, the injection cylinder 36 is actuated to forwardly move the plunger 33 at once. By the forward movement of the plunger 33, the metered semi-solidified slurry 7 accumulated in the front end of the metering cylinder 34 is injected through the nozzle 18 into the cavity of the molding plates (stationary plate 24 and movable plate 26).

Upon injection, since the semi-solidified slurry 7 is injected by the static mixer 51 while being radially mixed in the nozzle 18 into the molding plates 24 and 26, even if a portion of the solid particles in the semi-solidified slurry 7 is grown coarsely, the solid particles are refined when they pass through the nozzle 18.

Therefore, this can prevent grown solid particles from intruding into the molding products, to obtain satisfactory molding products in which refined solid particles are uniformly dispersed with no pores. It has been confirmed by the experiment that the size of the solid particles is reduced by about 10% compared with the case of not using the mixer 51.

Further, since the solid particles in the semi-solidified slurry 7 are refined, and this can prevent the grown solid particles from clogging the nozzle 18 and increasing the resistance to the passage of the light metal alloy material, and enables stable molding operation.

Further, in this embodiment, since the inside of the nozzle 18 is heated to and above the solidus temperature by the heating member 67, this can prevent the solid particles from easily clogging the inside of the inner channel 50 by the provision of the mixer 51 and ensures stable molding operation also in this regard.

Then, when the injection of the semi-solidified slurry 7 has thus been completed, the solid plug is formed at the inside of the discharge port 65 by the cooling for the spool bush 38 with the temperature setting member 39 based on the injection completion signal from the injection plunger 33 and, subsequently, the driving motor 11 for the screw extruder 4 is actuated to start the metering for the next injection shot by the injection plunger 33.

Figure 8:
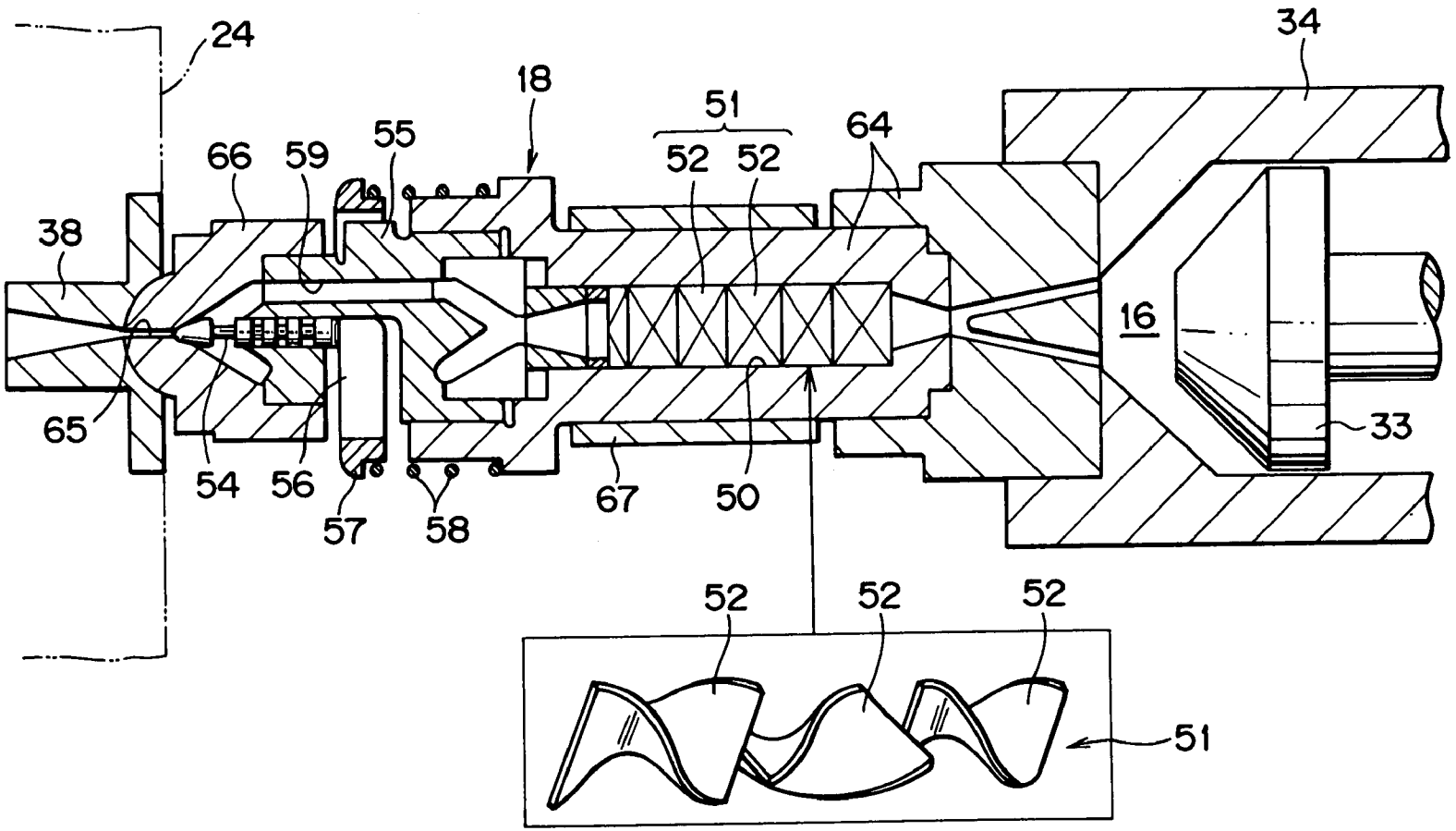
FIG. 8 is a cross sectional view of a nozzle according to another embodiment of the present invention.

FIG. 8 shows a second embodiment of the nozzle 18 for light metal alloy injection usable for the injection molding apparatus 1.

The nozzle 18 comprises a self closing type nozzle having an on/off valve 54 at the inside and it comprises a cylindrical nozzle main body 64 screw coupled at a base end to a discharge port of a metering cylinder 34, an intermediate cylinder 55 fitted to the top end of the nozzle main body 64, a tip member 66 fitted to the top end of the intermediate cylinder 55 and having a discharge port 65, and a heating member 67 comprising a band heater or the like wound around the periphery of the nozzle main body 64.

The on/off valve 54 comprising a needle valve is axially inserted slidably at a central portion of the intermediate cylinder 55, such that the discharge port 65 can be opened/closed by the axial movement of the valve 54. A ring member 57 having an arm 56 abutting against the rear end of the on/off valve 54 is fitted over the outer circumference of the intermediate cylinder 55, and the ring member 57 is resiliently biased to the mold (leftward in FIG. 8) by a spring member 58 fitted over the top end of the nozzle main body 64.

An injection channel 59 for the light metal alloy material is formed at the periphery of the on/off valve 54 in the intermediate cylinder 55, and the channel 59 is widened at the front end of the on/off valve 54 and in communication with the discharge port 65.

Also in the nozzle 18 of this embodiment, a static mixer 51 comprising a plurality of stirring blades 52 is contained in the inner channel 50 of the nozzle main body 64, by which the semi-solidified slurry 7 passing through the inner channel 50 is radially mixed and the solid particles contained therein are refined.

Therefore, the nozzle 18 can prevent the on/off valve 54 disposed at the downstream in the mixer 51 from being hindered for opening/closure by the grown solid particles and enable stable molding operation.

Further, since other constitutions and the functions are identical with those of the first embodiment of the nozzle 18, corresponding portions carry the same references in the drawing, for which detailed explanations are omitted.

Figure 9:
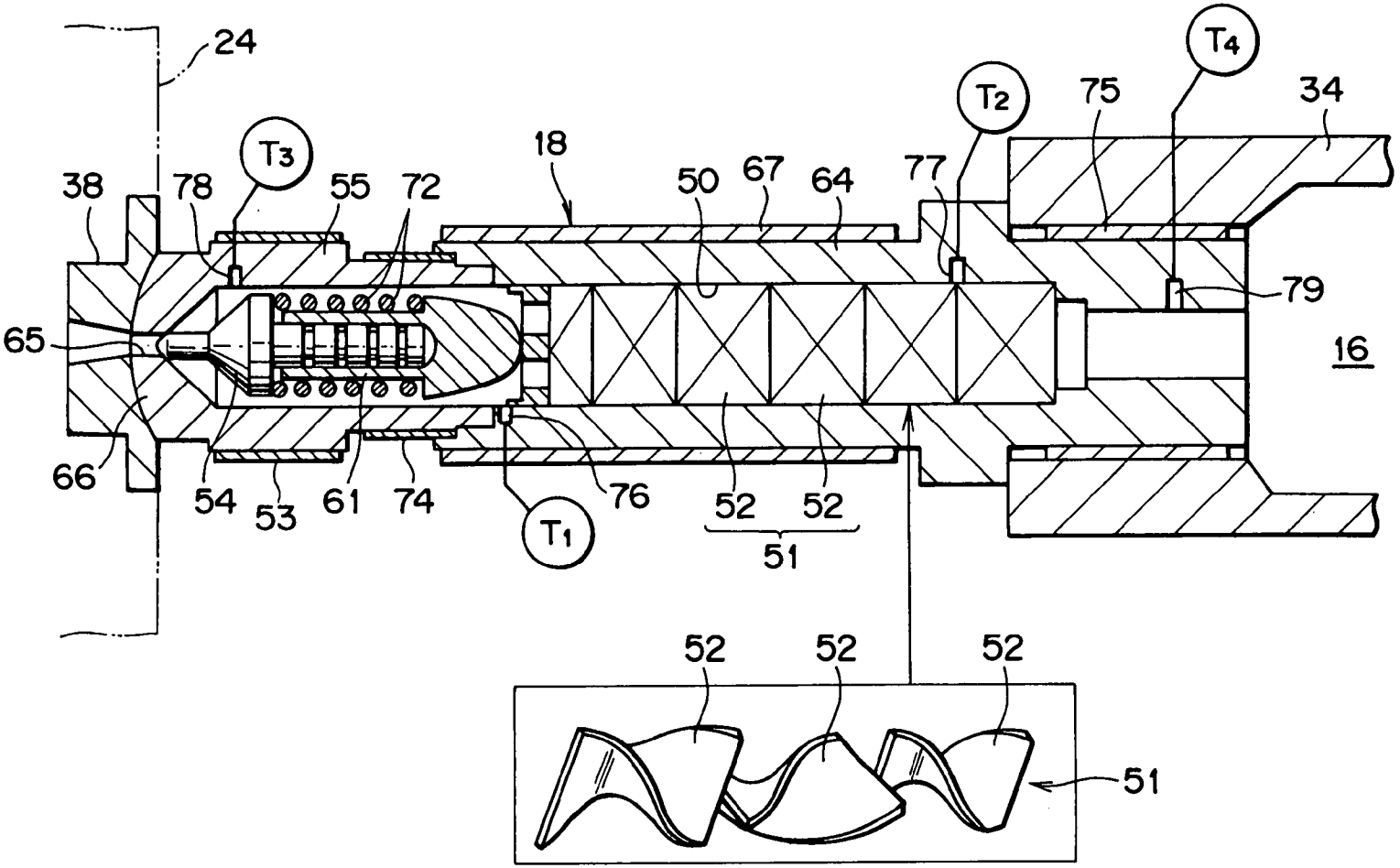
FIG. 9 is a cross sectional view of a nozzle according to a further embodiment of the present invention.

FIG. 9 shows a third embodiment of a nozzle 18 for light metal alloy injection usable for the injection molding apparatus 1.

Also the nozzle 18 comprises, like that the nozzle of the second embodiment, a self-closing type nozzle having an on/off valve 54 at the inside and comprises a cylindrical nozzle main body 64 screw coupled at a base end with a discharge port of a metering cylinder 34, an intermediate cylinder 55 fitted to the top end of the nozzle main body 64, a tip member 66 having a discharge port 65 and formed integrally to the top end of the intermediate cylinder 55 and a heating member 67 comprising a band heater or the like wound around the periphery of the nozzle main body 64, in which a static mixer 51 comprising a plurality of stirring blades 52 is contained in an inner channel 50 of the nozzle main body 64.

The on/off valve 54 is inserted axially slidably in a guide cylinder 61 contained in an intermediate cylinder 65, and a spring member 72 is fitted over the outer circumference of the cylinder 61 for resiliently biasing the on/off valve 54 to the mold (leftward in FIG. 9).

Further, the nozzle 18 comprises, in addition to the heating member 67 for heating a portion corresponding to the static mixer 51, a second heating main body 53 wound around the top end of the intermediate cylinder 55, a third heating member 74 wound around the base end of the intermediate cylinder 55 and a fourth heating member 75 wound around the base end of the nozzle member 64, in which first to fourth temperature sensors 76 to 79 each comprising a thermocouple or the like are disposed near the exit of the mixer 51, near the inlet of the mixer 51, near the exit of the intermediate cylinder 55 and near the inlet of the nozzle main body 64 respectively.

Then, each of the heating members 53, 67, 74 and 75 conducts temperature control such that the temperature T4 of the fourth temperature sensor 79 at the upstream of the static mixer 51 is at a semi-solidification temperature in which solid and liquid phases exist together, and further, such that the temperature T1 to T3 for the first to the third temperature sensors 76 to 78, as: $T3 \geqq T1 > T2$ within a range above the liquidus temperature of the light metal alloy.

As described above, by setting the temperature of the light metal alloy in a portion upstream to the static mixer 51 to a semi-solidification temperature by the fourth heating element 75, degradation of the quality of the molding product by the lowering of the solid phase rate of the semi-solidified slurry 7 in the metering cylinder 34 can be prevented effectively.

Further, also by setting the temperature T2 of the second temperature sensor 74 to a temperature as low as possible above the liquidus temperature, lowering of the solid phase rate of the semi-solidified slurry 7 is prevented in a portion upstream to the nozzle 18, and opening/closure of the on/off valve 54 is not hindered by the solid phase component by setting the temperature as: ($T3 \geqq T1 > T2$) such that the temperature is gradually higher toward the top end of the nozzle 18.

Since other constitutions and functions are identical with those of the second embodiment of the nozzle 18, corresponding portions carry identical references in the drawing, for which detailed explanations are omitted.

Figure 10A:
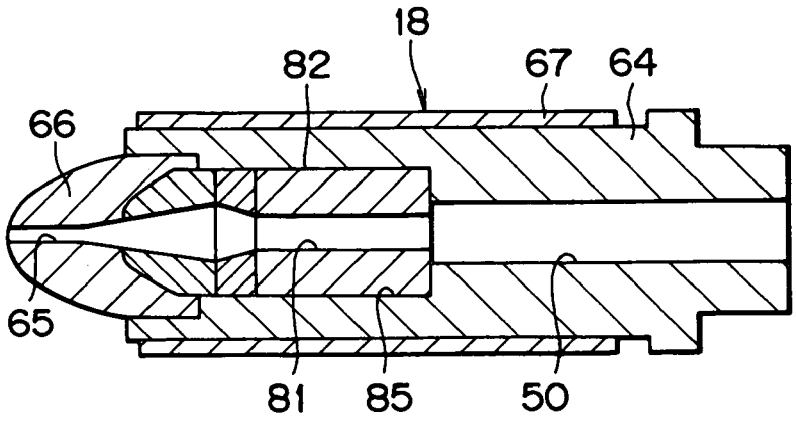
FIG. 10A is a cross sectional view of a nozzle according to other embodiment of the present invention.
Figure 10B:
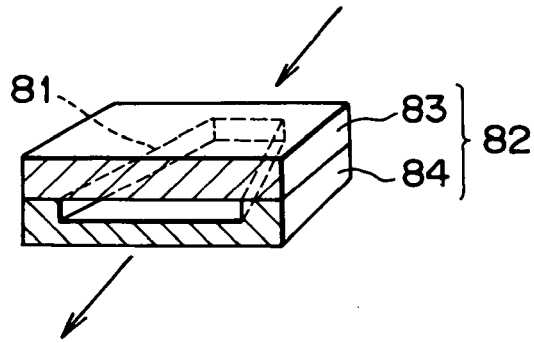
FIG. 10B is a perspective view of a shearing block.
Figure 10C:
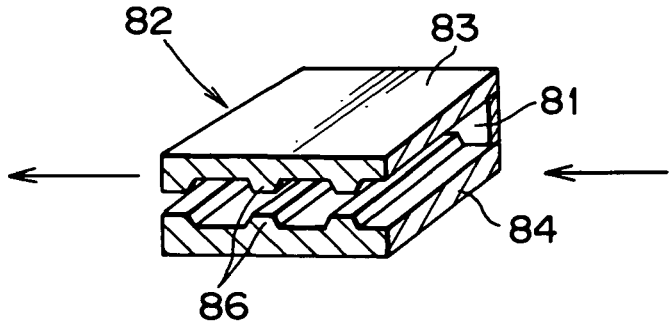
FIG. 10C is a perspective view showing a modified embodiment of the shearing block.

FIGS. 10A to 10C show a fourth embodiment of a nozzle 18 for light metal alloy injection usable for the injection molding apparatus 1.

The nozzle 18 in this embodiment is different from that of the first embodiment in providing a shearing block 82 constituting a slitwise injection channel 81 that causes shearing flow in the semi-solidified slurry 7 passing through the nozzle 18 instead of the mixer 51.

As shown in FIG. 10B, the block 82 comprises a lower plate 83 having a laterally long shallow groove on the upper surface and a flat upper plate 84 in contact with the upper surface of the lower plate 83, and the slitwise injection channel 81 is defined by closing the shallow groove of the lower plate 83 with the upper plate 84.

Then, as shown in FIG. 10A, the block 82 is contained in a widened portion 85 in the nozzle main body 64 such that the slitwise injection channel 81 is in communication with an inner channel 50 of the nozzle main body 64.

According to the nozzle 18, since the semi-solidified slurry 7 is injected to the molding plates 24 and 26 while generating a shearing flow in the slitwise injection channel 81 of the shearing block 82, if a portion of the solid particles in the semi-solidified slurry 7 is grown coarsely, such solid particles can be refined upon injection.

In a case where the flow resistance to the semi-solidified slurry 7 is excessively large if the injection channel 81 in the shearing block 82 is formed slitwise over the entire axial direction, solid particles of the semi-solidified slurry 7 can be refined without increasing the flow resistance not so much if ridges 86 are disposed each at a predetermined distance in the flowing direction of the material at the inner surface of the block 82 as shown in FIG. 10C.

An example of the block 82 contained in the nozzle main body 64 is shown but a slitwise injection channel 81 may be disposed directly to the inside of the nozzle main body 64.

Figure 11:
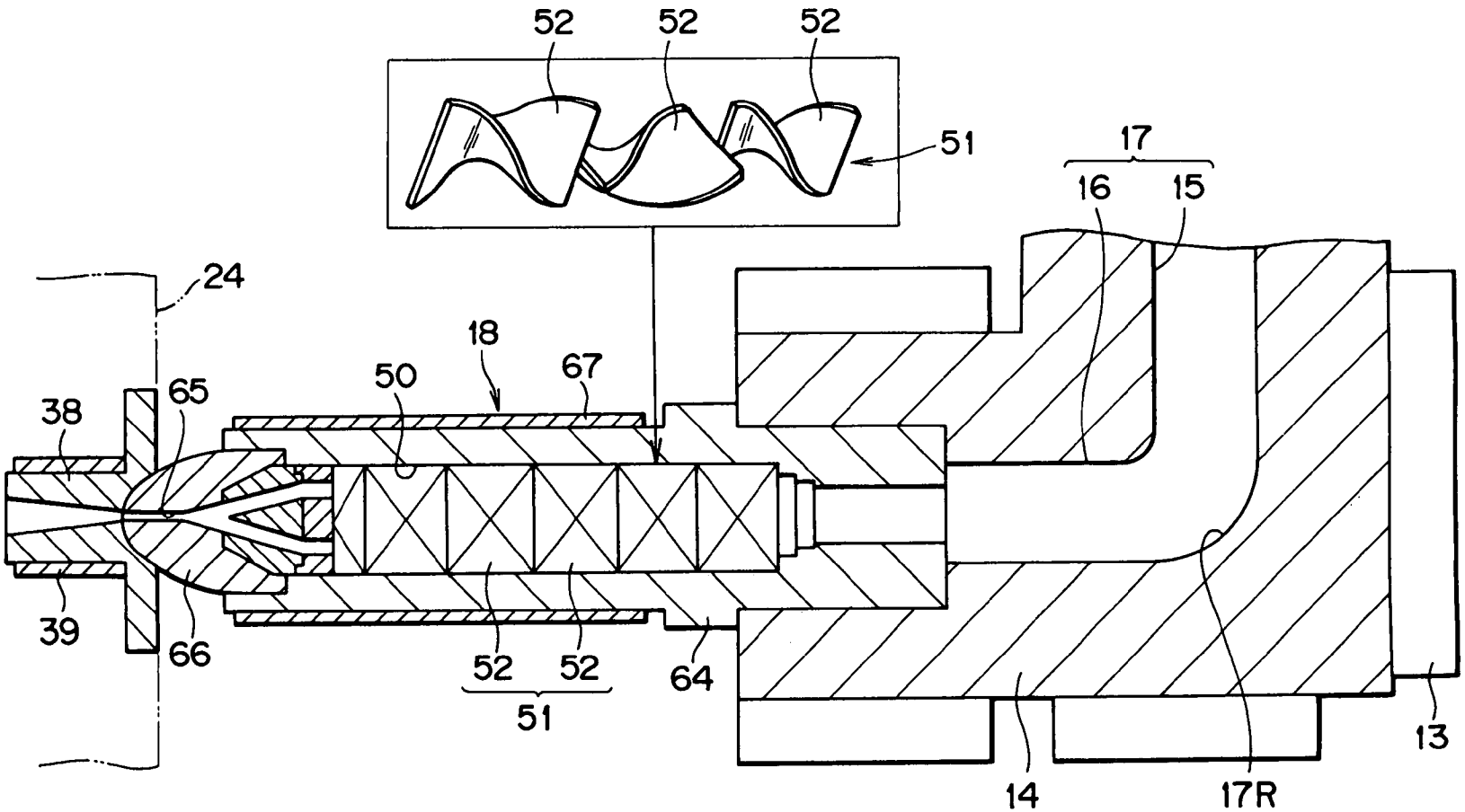
FIG. 11 is an explanatory view of applying the nozzle in FIG. 7 to an in-line system injection molding apparatus.
Figure 12:
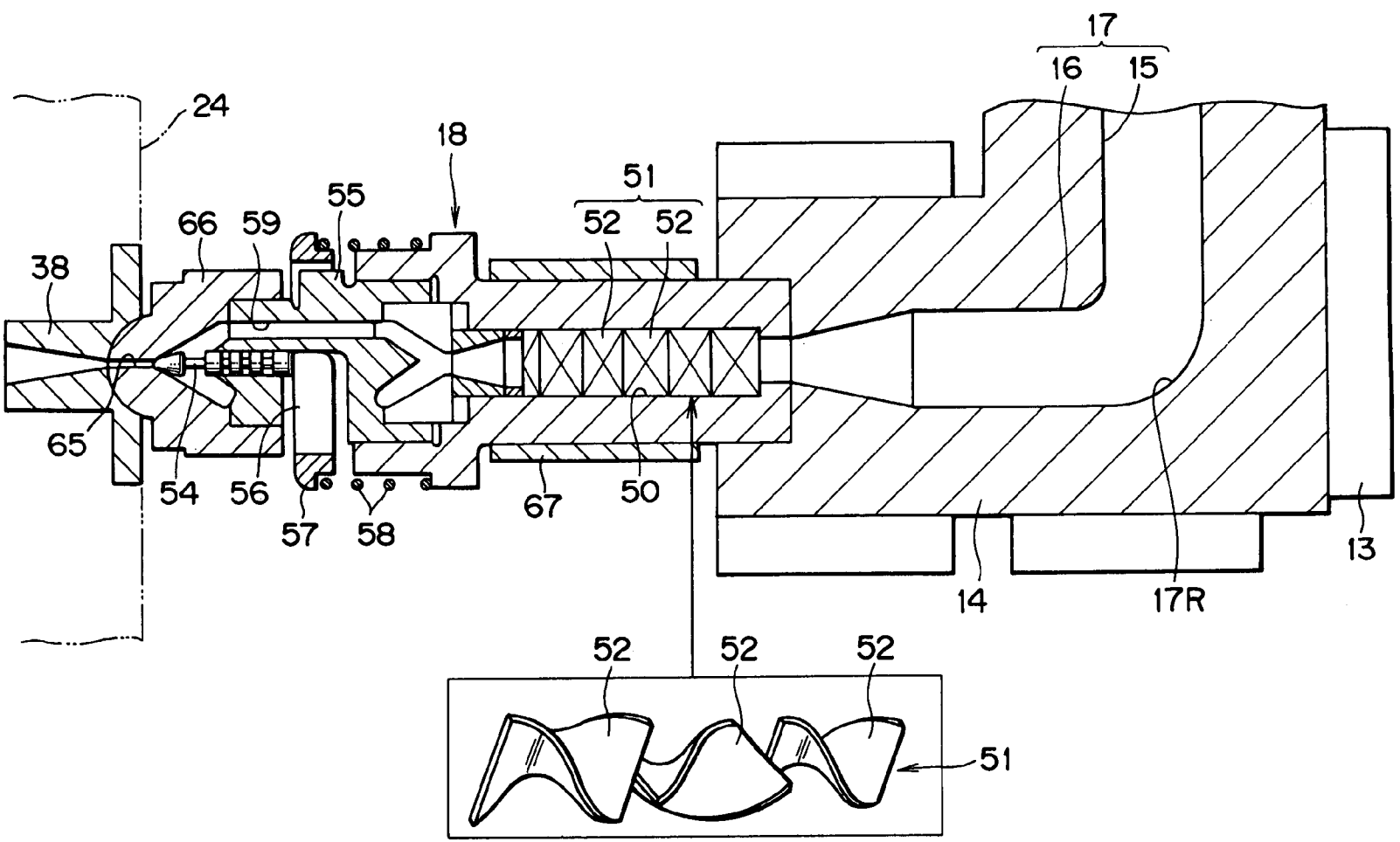
FIG. 12 is an explanatory view of applying the nozzle in FIG. 8 to an in-line system injection molding apparatus.
Figure 13:
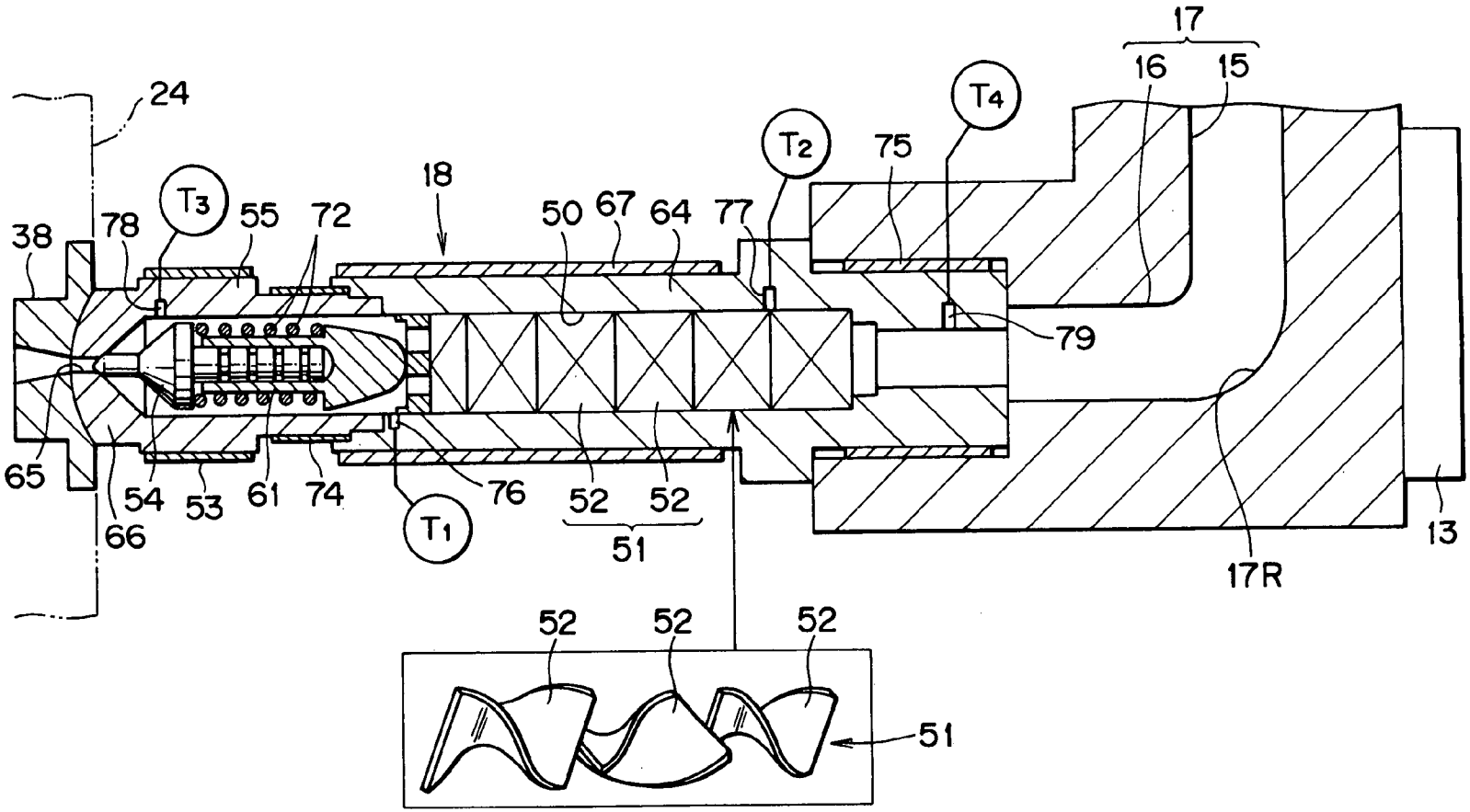
FIG. 13 is an explanatory view of applying the nozzle in FIG. 9 to an in-line system injection molding apparatus.

The first to fourth embodiments of the nozzles described above are not limited only to the use for the injection molding machine shown in FIG. 3 but they can be used suitably also to in-line system injection molding apparatus shown in FIG. 1, FIG. 2 and FIG. 4 as shown in FIG. 11 to FIG. 13. Further, they are also applicable to the following type injection molding apparatus. An injection molding apparatus 1 shown in FIG. 14 is an injection molding apparatus according to a so-called thixo-molding process, which is different from the embodiments shown in FIG. 1 to FIG. 4 using the molten metal 5 as the starting material in that a pellet or chip-like solid material 69 is heated at the inside of a screw extruder 4 and the material 69 is formed into a semi-solidified state.

That is, the solid material 69 is charged in the state of the solid as it is to a material hopper 70 connected to a rear end of a chamber 2, and the material 69 is formed by heating into a semi-solidified slurry by a temperature control jacket 13 provided to the outer circumference of the chamber 2 and the semi-solidified slurry is injected by an extrusion screw 3 moving forward by an injection cylinder 36 into molding plates 24 and 26.

Figure 14:
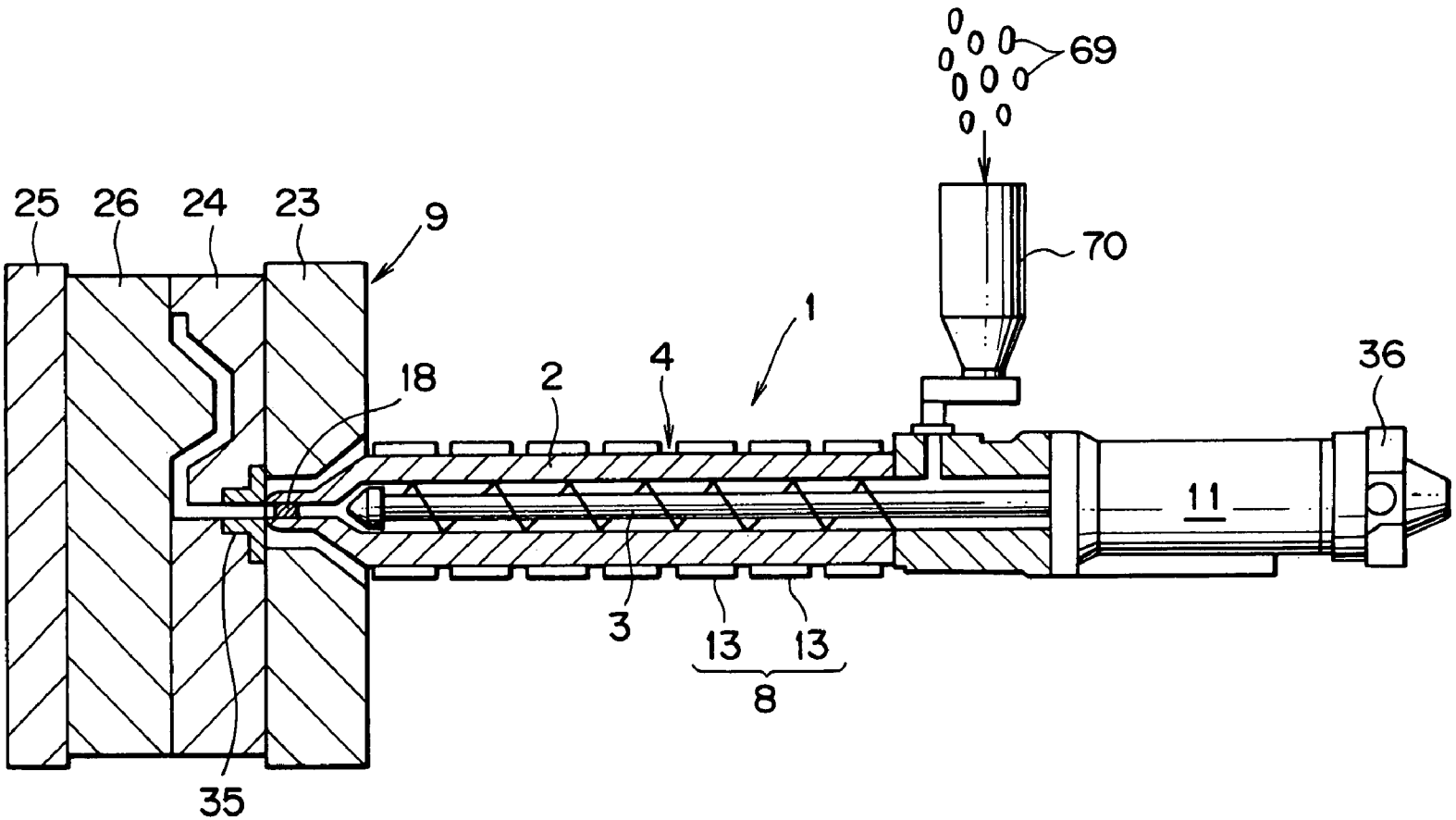
FIG. 14 is an entire side elevational view showing a modified embodiment of an injection molding apparatus according to the present invention.

For components having structures and functions identical with those in FIG. 1 carry same reference numerals in FIG. 14 and detailed explanation therefor are omitted.

While each of the preferred embodiments according to the present invention has been explained as above, such embodiments are merely illustrative but not limitative. The technical scope of the present invention is defined according to the scope of the claims and all embodiments contained therein are encompassed within the range of the present invention.

For example, for the self-closing type nozzle 18, those conducting opening/closing operation by a rotary type valve can be used in addition to those conducting opening/closing operation by a needle valve.

What is claimed is:

1. An injection molding apparatus for a light metal alloy, comprising:

a chamber;

a extrusion screw located substantially vertically and provided rotationally inside said chamber, wherein the extrusion screw is mounted for movement in the axial direction thereof, to extrude the molten metal or the semi-solidified slurry;

a connection member having a first internal channel substantially in a vertical direction and a second internal channel extending horizontally from the lower end of the first channel, said connection member being connected to a discharge port of said chamber;

a nozzle connected at the discharge end of said second internal channel;

nozzle discharge port opening/closing means for opening or closing a discharge port of said nozzle;

a clamping device for injection molding the molten metal or the semi-solidified slurry discharged from said nozzle, wherein said clamping device is adapted to open or close a movable plate relative to a stationary plate in a horizontal direction;

a hopper connected to the upper end of the chamber;

a level sensor for detecting the surface height of a molten metal in said hopper; and control means for controlling the supply of the molten metal to said hopper based on a signal from said level sensor so that the surface height of the molten metal is lower than a shaft seal of the extrusion screw.

2. An injection molding apparatus as defined in claim 1, further comprising a cooling unit for cooling the molten metal supplied in said chamber.

3. An injection molding apparatus for a light metal alloy, comprising:

a chamber;

an extrusion screw located substantially vertically and provided rotationally inside said chamber;

a connection member having a first internal channel substantially in a vertical direction and a second internal channel extending horizontally from the lower end of the first channel, said connection member being connected to a discharge port of said chamber;

an injection plunger provided in the second internal channel, said injection plunger moving in the horizontal direction for injecting the molten metal or semi-solidified slurry;

a nozzle connected at the discharge end of said second internal channel;

nozzle discharge port opening/closing means for opening or closing a discharge port of said nozzle;

a clamping device for injection molding the molten metal or the semi-solidified slurry discharged from said nozzle, wherein said clamping device is adapted to open or close a movable plate relative to a stationary plate in a horizontal direction;

a hopper connected to the upper end of the chamber;

a level sensor for detecting the surface height of a molten metal in said hopper; and control means for controlling the supply of the molten metal to said hopper based on a signal from said level sensor so that the surface height of the molten metal is lower than a shaft seal of the extrusion screw.

4. An injection molding apparatus as defined in claim 3, further comprising a cooling unit for cooling the molten metal supplied in said chamber.

5. An injection molding apparatus for a light metal alloy as defined in claim 1, further comprising a cooling unit for cooling a light metal material supplied in said chamber.

6. An injection molding apparatus for a light metal alloy, comprising:

a chamber;

a extrusion screw located substantially vertically and provided rotationally inside said chamber to extrude the molten metal or the semi-solidified slurry;

a connection member having a first internal channel substantially in a vertical direction and a second internal channel extending horizontally from the lower end of the first channel, said connection member being connected to a discharge port of said chamber;

a nozzle connected at the discharge end of said second internal channel;

a clamping device for injection molding the molten metal or the semi-solidified slurry discharged from said nozzle, wherein said clamping device is adapted to open or close a movable plate relative to a stationary plate in a horizontal direction;

a hopper connected to the upper end of the chamber;

a level sensor for detecting the surface height of a molten metal in said hopper; and control means for controlling the supply of the molten metal to said hopper based on a signal from said level sensor so that the surface height of the molten metal is lower than a shaft seal of the extrusion screw.

7. An injection molding apparatus for a light metal alloy, comprising:

a chamber;

an extrusion screw located substantially vertically and provided rotationally inside said chamber;

a connection member having a first internal channel substantially in a vertical direction and a second internal channel extending horizontally from the lower end of the first channel, said connection member being connected to a discharge port of said chamber;

an injection plunger provided in the second internal channel, said injection plunger moving in the horizontal direction for injecting the molten metal or semi-solidified slurry;

a nozzle connected at the discharge end of said second internal channel;

a clamping device for injection molding the molten metal or the semi-solidified slurry discharged from said nozzle, wherein said clamping device is adapted to open or close a movable plate relative to a stationary plate in a horizontal direction;

a hopper connected to the upper end of the chamber;

a level sensor for detecting the surface height of a molten metal in said hopper; and control means for controlling the supply of the molten metal to said hopper based on a signal from said level sensor so that the surface height of the molten metal is lower than a shaft seal of the extrusion screw.

* * * * *

UNITED STATES PATENT AND TRADEMARK OFFICE

CERTIFICATE OF CORRECTION

PATENT NO. : 7,163,046 B2
APPLICATION NO. : 10/914153
DATED : January 16, 2007
INVENTOR(S) : Tanaka et al.

It is certified that error appears in the above-identified patent and that said Letters Patent is hereby corrected as shown below:

On the title page, Item (73), the Assignee Information is incorrect. Item (73) should read:

-- (73) Assignee: Kabushiki Kaisha Kobe Seiko Sho
(Kobe Steel, Ltd.) Kobe (JP)--

Signed and Sealed this

Twenty-seventh Day of March, 2007

JON W. DUDAS
*Director of the United States Patent and Trademark Office*